US009182206B2

(12) United States Patent
Carton et al.

(10) Patent No.: US 9,182,206 B2
(45) Date of Patent: Nov. 10, 2015

(54) METHOD FOR LIFTING A FIRING SAFETY DETENT AND PROJECTILE USING THIS METHOD

(71) Applicant: MBDA FRANCE, Paris (FR)

(72) Inventors: Laurent Carton, Saint-Florent sur Cher (FR); Bernard Tisseron, Marzy (FR)

(73) Assignee: MBDA France, Paris (FR)

( * ) Notice: Subject to any disclaimer, the term of this patent is extended or adjusted under 35 U.S.C. 154(b) by 0 days.

(21) Appl. No.: 14/373,849

(22) PCT Filed: Jan. 30, 2013

(86) PCT No.: PCT/FR2013/000029

§ 371 (c)(1),
(2) Date: Jul. 22, 2014

(87) PCT Pub. No.: WO2013/117829

PCT Pub. Date: Aug. 15, 2013

(65) Prior Publication Data

US 2015/0114248 A1 Apr. 30, 2015

(30) Foreign Application Priority Data

Feb. 8, 2012 (FR) ..... 12 00381

(51) Int. Cl.
*F42C 15/18* (2006.01)
*F42C 15/295* (2006.01)

(52) U.S. Cl.
CPC ..... *F42C 15/295* (2013.01)

(58) Field of Classification Search
CPC ..... F42C 9/06; F42C 15/28; F42C 15/29; F42C 15/295
USPC ..... 102/225, 226, 227, 263
See application file for complete search history.

(56) References Cited

U.S. PATENT DOCUMENTS

| | | | | |
|---|---|---|---|---|
| 1,234,358 | A * | 7/1917 | McCandlish | 102/227 |
| 1,793,567 | A | 2/1931 | Teitscheid | |
| 2,779,277 | A * | 1/1957 | Smith | 102/417 |
| 2,943,569 | A | 7/1960 | Wolfe | |
| 2,989,920 | A | 6/1961 | Kendall | |
| 3,170,403 | A * | 2/1965 | Heilprin | 102/208 |
| 3,382,805 | A * | 5/1968 | Swaim | 102/228 |
| 3,552,318 | A | 1/1971 | Briggs | |
| 3,779,194 | A | 12/1973 | Kahn | |
| 3,973,501 | A | 8/1976 | Briggs | |
| 4,027,593 | A * | 6/1977 | Campagnuolo et al. | 102/208 |
| 4,567,828 | A * | 2/1986 | Campagnuolo et al. | 102/208 |
| 6,481,354 | B1 | 11/2002 | Heck et al. | |

FOREIGN PATENT DOCUMENTS

| | | |
|---|---|---|
| DE | 3322926 A1 | 1/1985 |
| FR | 2193191 | 2/1974 |
| FR | 2566892 A1 | 1/1986 |
| FR | 2927695 A1 | 8/2009 |
| GB | 103182 | 1/1917 |
| GB | 550897 | 1/1943 |

* cited by examiner

*Primary Examiner* — Gabriel Klein
(74) *Attorney, Agent, or Firm* — Reinhart Boerner Van Deuren P.C.

(57) ABSTRACT

According to the invention, in order to lift said safety detent, use is made of a multi-vane fan (5), which is arranged inside the fuselage (2) of the projectile, but the vanes (4) of which pass through said fuselage (2) via a lateral opening (3).

8 Claims, 2 Drawing Sheets

METHOD FOR LIFTING A FIRING SAFETY DETENT AND PROJECTILE USING THIS METHOD

The present invention relates to a method for lifting at least one firing safety detent of a warhead carried by a projectile, as well as a projectile implementing said method.

It is known that certain aerial bombs are provided with a non-detachable external wind wheel, which is set into aerodynamical rotation when said bombs are falling to the ground and is used to arm the warhead of said bombs. In a particular embodiment of a mine disclosed in the document DE 3322 926 A1, a wind wheel is provided on the outside of the body of the mine so as to be able to rotate about the axis of said body.

Regardless of their arrangement, such external wind wheels generate significant drag and they are also vulnerable. The result is that the arming devices with an external wind wheel cannot be used for projectiles other than bombs, for example for missiles.

Furthermore, for example in the documents U.S. Pat. No. 1,793,567, GB 550897, U.S. Pat. Nos. 3,552,318, 6,481,354, FR 2566892 and FR 2927695, devices for arming projectile fuses are known that comprise a wind wheel inside said fuses. Such internal wind wheels are therefore protected inside the fuse and they do not exert any negative influence on the aerodynamics of the projectile. Nevertheless, they require the production, in said fuses, of an internal circuit for the intake and circulation of air in order to set them into rotation; furthermore, such a circuit limits the performance of the arming device.

The object of the invention is to overcome these disadvantages.

To this end, according to the invention, the method for lifting at least one firing safety detent of a warhead disposed in the fuselage of a projectile, with said method implementing a wind wheel driven in rotation by the airflow surrounding said projectile during its flight, is noteworthy in that:

- a lateral opening is made in said fuselage of said projectile, and
- said wind wheel is arranged about an axis disposed inside said fuselage at least substantially orthogonally to the axis of said projectile so that said wind wheel is mostly located inside said fuselage, but that, during the rotation of said wind wheel, the peripheral ends of the vanes of said wind wheel successively pass through said lateral opening so as to project outside of said fuselage.

Therefore, the vulnerability and the aerodynamic drag of such a wind wheel, which is mostly located inside the fuselage of the projectile, are reduced, without adversely affecting the performance of said wind wheel and without requiring the production of a circuit for circulating air inside said projectile.

The projectile according to the present invention and which comprises a fuselage that houses the following:

- a warhead, the firing of which is prevented by at least one safety device, and
- an arming device having a wind wheel capable of acting on said safety device so as to inhibit the action thereof, said wind wheel being set into rotation by the airflow surrounding said projectile during its flight,
- is therefore noteworthy in that said fuselage of the projectile comprises a lateral opening, in that the axis of rotation of said wind wheel is disposed inside said fuselage at least substantially orthogonally to the axis of said projectile, in that said wind wheel is mostly located inside said fuselage and in that said lateral opening is designed to be successively passed through, during the rotation of said wind wheel, by the peripheral ends of the vanes of said wind wheel so as to project outside of said fuselage.

Said arming device can comprise a movable block driven, from the wind wheel, by means of a bevel gearing device, and said movable block can be moved by a screw driven in rotation by said bevel gearing device.

It can be seen that, in this way, the bevel gearing device and said block drive screw allow the speed of rotation of the wind wheel to be increased so as to obtain the required progressivity for the displacement of said block.

Preferably, the axis of said screw displacing said movable block is at least substantially orthogonal to the axis of the wind wheel.

In one advantageous embodiment, a controllable coupling device is provided on the rotary shaft of said wind wheel so as to allow said wind wheel to be decoupled from the rest of said arming device, and a contactor is used for controlling said coupling device, said contactor being actuated by an element of the arming device, preferably the block, when said arming device has inhibited the action of the safety device.

Thus, after lifting the firing safety detent, the wheel can be caused to idle so as to further reduce the aerodynamic drag that it generates.

Furthermore, in order to allow the handling, maintenance, transportation, etc. of the projectile, it is advantageous for said projectile to comprise detachable mechanical means for blocking said movable block.

The figures of the appended drawings will be useful for understanding how the invention can be produced. In these figures, identical reference numerals designate similar elements.

Figure 1:
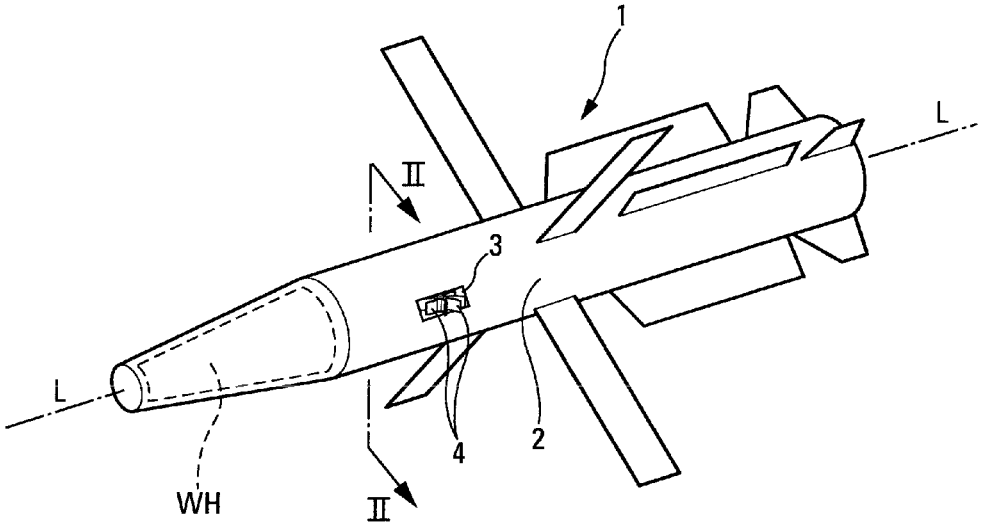
FIG. 1 shows a perspective view of a missile provided with a wind wheel according to the present invention.

The missile 1, shown in FIG. 1, comprises a fuselage 2, having a longitudinal axis L-L, which houses a warhead WH and in which a lateral opening 3 of longitudinally extended shape is made. The ends of the vanes 4 of a wind wheel 5 disposed inside said fuselage 2 pass through said lateral opening 3 from the inside to the outside of the fuselage 2.

Figure 2A:
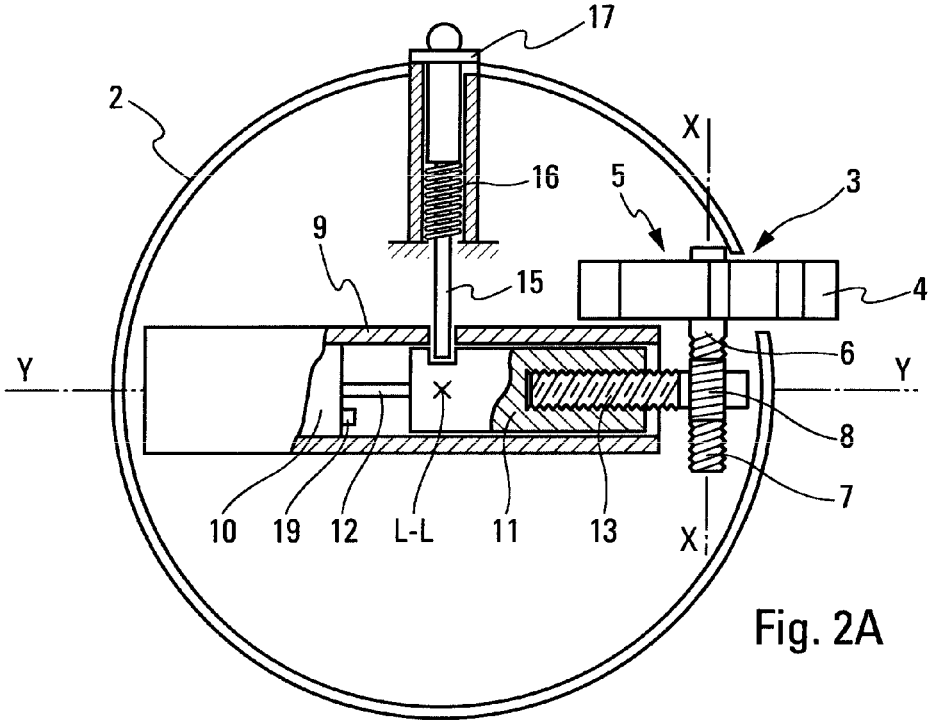
FIG. 2A shows an enlarged schematic section, along the line II-II of FIG. 1, showing the arrangement of the wind wheel of the present invention when the missile is stowed or waiting to be fired.
Figure 2B:
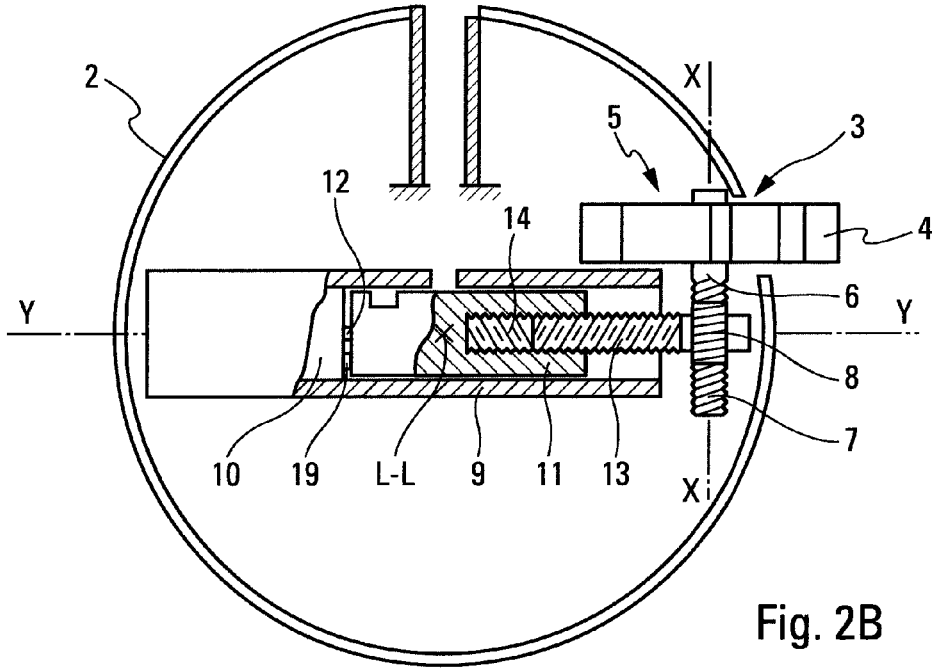
FIG. 2B shows an enlarged schematic section, along the line II-II of FIG. 1, showing the arrangement of the wind wheel of the present invention when the missile is armed.

As schematically shown in FIGS. 2A and 2B, the axis of rotation X-X of the wind wheel 5 is substantially orthogonal to the longitudinal axis L-L of the fuselage 2 of the missile 1.

The wind wheel 5 comprises a shaft 6, having an axis X-X, inside the fuselage 2 and extended by a worm screw 7, meshing with a gear 8, so as to form a bevel gear at 90°. Thus, the axis Y-Y of the gear 8 is orthogonal to the axis X-X of the wind wheel 5. Furthermore, the axis Y-Y of the gear 8 can be, as shown in FIGS. 2A and 2B, orthogonal to the axis L-L of the missile.

A body 9 is also located inside the fuselage 2, with a safety device 10 being mounted inside said body so as to prevent the firing of the warhead WH. A block 11 is movably mounted in the body 9, which block supports a component 12 capable of acting on the safety device 10 so as to inhibit the action thereof. The block 11 is engaged with a screw 13 which is rigidly connected to the gear 8, coaxial therewith and meshes with a thread 14 of said block 11.

Furthermore, a pin 15 loaded by a spring 16, which is kept compressed by a key 17, is capable of blocking the block 11 in the body 9.

FIG. 2A shows the arrangement of the various elements 2 to 16 previously described when the missile 1 is stowed, is under maintenance, is being transported or is in any other phase during which the warhead WH must not be armed. In the arrangement of FIG. 2A, the pin 15 retained by the key 17 blocks the block 11 inside the body 9, the result of which is that the component 12 cannot act on the safety device 10 and that the wind wheel 5 is rotationally blocked by means of the screw 13 and the bevel gear 7, 8.

When the missile 1 has to be launched, firstly the key 17 is removed so that the spring 16 ejects the pin 15 and so that the block 11 in the body 9 is no longer blocked (see FIG. 2B). Subsequently, the missile 1 is launched and the result is that the peripheral parts of the vanes 4 of the wind wheel 5, which vanes are positioned outside of the fuselage 1 in passing through said lateral opening 3, and are subject to the pressure of the airflow surrounding said fuselage 2. The wheel 5, inside the fuselage 2, is therefore set into rotation, with the peripheral ends of the vanes 4 successively passing through said lateral opening 3.

Following such aerodynamic setting into rotation of the wheel 5, the screw 13 is in turn driven in rotation about its axis Y-Y by the bevel gear 7, 8 and, by its cooperation with the thread 14, it displaces the block 11 and the component 12 towards the safety device 10.

The progressive advance of the block towards the safety device 10 depends, among other parameters, on the speed of the missile 1, the aerodynamic performance of the wheel 5, the gear ratio between the worm screw 7 and the gear 8 and the pitch of the screw 13 and of the thread 14. Given the distance that the block 11 has to cover so that its component 12 inhibits the safety imposed by the device 10, the time for lifting this safety is therefore perfectly defined.

Figure 3:
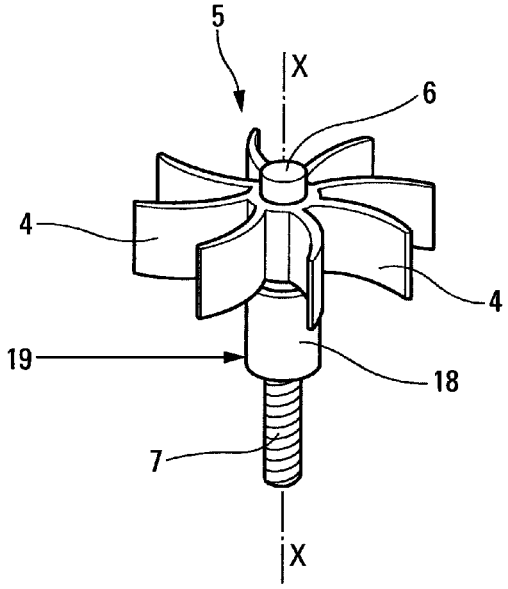
FIG. 3 shows a perspective view of an embodiment of the wind wheel according to the present invention associated with a release device.

After the safety is lifted by the component 12, it can be advantageous, for aerodynamic drag reasons, for the wind wheel 5 to be decoupled from the block 11 so as to idle. In this case, a controllable coupling device 18 is provided on the shaft 6 between the wind wheel 5 and the worm screw 7. In order to control this coupling device 18 during decoupling, a contactor 19 is thus disposed in the body 9, with the position of said contactor corresponding to the end of the time for lifting the safety by the component 12 (see FIG. 3).

The invention claimed is:

1. A projectile comprising a fuselage, which fuselage houses the following:

a warhead (WH), the firing of which is prevented by at least one safety device, and an arming device having a wind wheel capable of acting on said safety device so as to inhibit an action of the safety device, said wind wheel being set into rotation by the airflow surrounding said projectile during its flight, wherein said fuselage of said projectile comprises a lateral opening, in that an axis of rotation (X-X) of said wind wheel is disposed inside said fuselage at least substantially orthogonally to an axis (L-L) of said projectile extending through a nose and a tail of the projectile, in that said wind wheel is mostly located inside said fuselage and in that said lateral opening is designed to be successively passed through, during the rotation of said wind wheel, by peripheral ends of vanes of said wind wheel so as to project outside of said fuselage.

2. The projectile according to claim 1, wherein said arming device comprises a movable block driven, from the wind wheel, by means of a bevel gearing device.

3. The projectile according to claim 2, comprising detachable mechanical means for blocking said movable block.

4. The projectile according to claim 2, wherein said movable block is moved by a screw driven in rotation by said bevel gearing device.

5. The projectile according to claim 4, wherein a rotational axis (Y-Y) of said screw along which the screw drives said movable block is at least substantially orthogonal to the axis (X-X) of said wind wheel.

6. The projectile according to claim 1, wherein a controllable coupling device is provided on a rotary shaft of said wind wheel so as to allow said wind wheel to be decoupled from the rest of said arming device.

7. The projectile according to claim 6, comprising a contactor for controlling said coupling device, said contactor being actuated by an element of said arming device when said arming device has inhibited the action of said safety device.

8. The projectile according to claim 7, wherein the element of said arming device that actuates the contactor is a block.

* * * * *